United States Patent [19]

Behar et al.

[11] Patent Number: 4,703,709

[45] Date of Patent: Nov. 3, 1987

[54] MODULAR SYSTEM FOR THE OFFSHORE PRODUCTION, STORAGE AND LOADING OF HYDROCARBONS

[75] Inventors: Isaac Behar, Paris; Hubert Berthet, Arles, both of France

[73] Assignee: Institut Francais du Petrole, Rueil-Malmaison, France

[21] Appl. No.: 603,156

[22] Filed: Apr. 23, 1984

[30] Foreign Application Priority Data

Apr. 21, 1983 [FR] France ..... 83 06715

[51] Int. Cl.[4] ..... B65D 89/10

[52] U.S. Cl. ..... 114/256; 114/264

[58] Field of Search ..... 114/256, 264, 265, 257; 405/202–205, 209, 210

[56] References Cited

U.S. PATENT DOCUMENTS

| | | | |
|---|---|---|---|
| 3,022,633 | 2/1962 | Stimson | 405/202 |
| 3,159,130 | 12/1964 | Vos | 114/256 X |
| 3,360,810 | 1/1968 | Busking | 114/256 X |
| 3,708,985 | 1/1973 | Pogonowski | 405/202 |
| 3,785,313 | 1/1974 | Rosenberg | 114/265 X |
| 3,824,943 | 7/1974 | Mo | 114/264 |

*Primary Examiner*—Sherman D. Basinger

*Attorney, Agent, or Firm*—Antonelli, Terry & Wands

[57] ABSTRACT

A modular offshore hydrocarbon production storage, and loading system, which includes an assembly of cylinders rigidly connected together, with the cylinders including at least one metal floatation cylinder adapted to occupy a vertical position in use. A bottom of the cylinder is situated below a level of the water and a floatation cylinder surrounded by several metal peripheral cylinders which descend below the floatation cylinder. The peripheral cylinders include metal oil storage cylinders, with the storage being effected on a water column communicating with the water surrounding the system, and metal balast cylinders or parts of cylinders filled with oil, water, air or inert gas.

5 Claims, 14 Drawing Figures

1
2
3
8
9
10
A1
A2

MODULAR SYSTEM FOR THE OFFSHORE PRODUCTION, STORAGE AND LOADING OF HYDROCARBONS

BACKGROUND OF THE INVENTION

The present invention relates to a modular system useable for offshore production, storage and/or loading of hydrocarbons.

Oil production at sea is normally carried out from production platforms connected to the land by pipe lines.

If the production of the field, quantity or duration, is insufficient to offset the cost of a pipe line connecting the platform to the coast, a platform must be provided for production and storage at sea.

Such systems, with a view to the production of so called marginal fields, have been developed.

One of these systems consists in using a semi submersible drilling platform converted for production.

The deck of the drilling platform is freed of drilling equipment, this being replaced by production equipment.

With the crude oil separated into three components (oil, water, gas), the oil is stored in a tanker permanently anchored on the field, by means of a buoy so that the tanker can constantly take up a position in the axis of the wind.

A second buoy is generally provided which serves as sea terminal and which allows a second tanker to shuttle between the field and the coast.

A second production system consists in using a tanker specially converted for production.

In this case, the same floating support serves for production (the equipment being placed on the deck) and for storage.

As in the above case, the tanker is permanently anchored to a buoy and a second buoy serves as sea terminal for unloading the oil into a second tanker which shuttles between the field and the coast.

These systems have two drawbacks:

(a) the necessity of transforming floating supports not provided for sea production and so not always adapted to requirements from the technical and cost points of view;

(b) limitation of the depth of water in which these systems may be used. These two systems are in effect dependent on the possibility of anchoring conventional buoys, which limits these systems in practice to water depths less than a 150 m (see, for example, the article "An analysis of tanker—Based floating production systems for small offshore fields", by Messrs. W. R. Leod and L. H. Sumudlers, Journal of Petroleum Technology, August 1982, page 1871 to 1879).

The prior art may be illustrated by U.S. Pat. Nos. 3,434,442 and 4,234,270 as well as by German patent applications Nos. 2.701.242 and 2.727.082.

An essential object of the present invention is to provide a floating production system comprising integrated storage, this system further forming the sea terminal and being able to be anchored in depths greater than those of conventional buoys.

Another important object of the invention is to provide a modular structure easily adaptable to requirements.

These objectives are attained, in accordance with the invention, with a floating modular system able to serve more especially for the offshore production, storage and/or loading of the hydrocarbons, comprising an assembly of cylinders connected rigidly together, which comprise in combination:

(a) at least one metal floatation cylinder, adapted to occupy a vertical position in use, the bottom of said floatation cylinder being situated below the level of the water and the top of said cylinder emerging above the level of the water and supporting a deck or platform with production and living equipment, said floatation cylinder being firmly secured to several metal cylinders descending possibly below the bottom of this floatation cylinder and comprising (b) metal cylinders for storing the oil, this storage being effected on a water column connected to the water surrounding the system, the level of the water in the cylinders lowering or rising depending on whether oil is stored or withdrawn, said storage cylinders being preferably entirely below the level of the surrounding water and (c) metal ballast cylinders or cylinder parts which may be more especially filled with oil, water, air or inert gas and associated regulation means adapted to compensate for the floatability variation of the system following variations of the water-oil level in the storage systems.

The storage and ballast cylinders may be joined to one another or not.

It should be understood that the term cylinder is to be understood in its widest sense and not only in the sense of a cylinder of revolution although this form is convenient to construct.

According to a particular embodiment, the storage and ballast cylinders are disposed at least around the floatation cylinder which will then occupy a central position. In this case, the storage and ballast cylinders are termed peripheral cylinders and the floatation cylinder is termed central cylinder.

In another particular embodiment, the metal floatation cylinder will not be used and only the assembly formed of the storage and ballast cylinders disposed possibly about an axis will be kept. Floatation may then be provided by one or more floats connected more especially directly to said assembly or by the positive buoyancy of some at least of the storage or ballast cylinders. In this particular case, the platform or the deck may be connected directly to the assembly by assembly legs.

BRIEF DESCRIPTION OF THE DRAWINGS

Particular embodiments of the invention are described hereafter solely by way of example, with reference to the accompanying drawings in which.

; and

Figure 9:
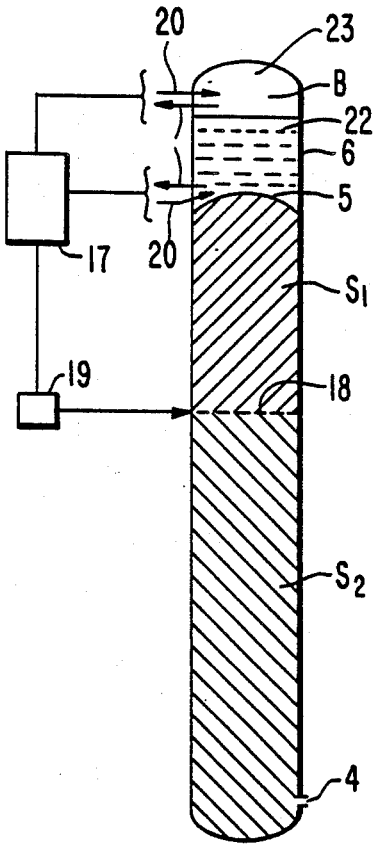

FIG. 9 is a cross sectional view of a peripheral cylinder with control means for controlling a stability thereof.

DETAILED DESCRIPTION

In the embodiments of the invention illustrated in the Figures, reference 1 designates generally a modular system for producing, storing and/or loading hydrocarbons coming from an under water well assembly (not shown), this system comprising an assembly of cylinders connected rigidly together.

These cylinders comprise in combination:

(a) at least one metal floatation cylinder $A_1$, adapted to occupy a vertical position in use (FIG. 1), the bottom of this cylinder then being situated below the level 2 of the water. The upper part of cylinder $A_1$ emerges, in use, above the level of the water and supports a deck or platform 3 comprising production and living equipment.

This emergent part of cylinder $A_1$ forms a terminal to which oil ships shuttling between this terminal and the coast will tie up.

The floatation cylinder $A_1$ is surrounded by at least one ring of peripheral metal cylinders $A_2,A_3$. . . which descend below cylinder $A_1$. This arrangement frees, under the floatation cylinder $A_1$ a free space E (FIG. 1C) defined by the ring of peripheral cylinders $A_2,A_3$. . . If required, this free space E may be used for placing therein members for increasing the rigidity of the system, or for housing therein some form of ballast or a subsidiary cylinder.

These peripheral cylinders comprise:

(b) metal cylinders for storing the oil, this storage $S_1$ being effected on a water column $S_2$ communicating at 4 with the water surrounding the system. The oil floats on the water, the hydrostatic oil+water column being balanced with the surrounding water. Thus, the level of the water in the cylinders such as $A_2$ is lowered or rises depending on whether oil is stored or withdrawn.

The storage cylinders such as $A_2$, in use, are entirely situated below the level 2 of the surrounding water. So as to avoid pollution of the sea water by the oil, a sufficient guard will be provided at the bottom of the storage cylinders as well as a safety system preventing the oil level from dropping below a fixed limit level. The water contaminated with oil may undergo an appropriate physico-chemical treatment before being thrown back in the sea or will remain in a siphon or buffer cylinder.

(c) metal ballast cylinders or parts of cylinders B filled with oil, water, air or inert gas.

Figure 8:
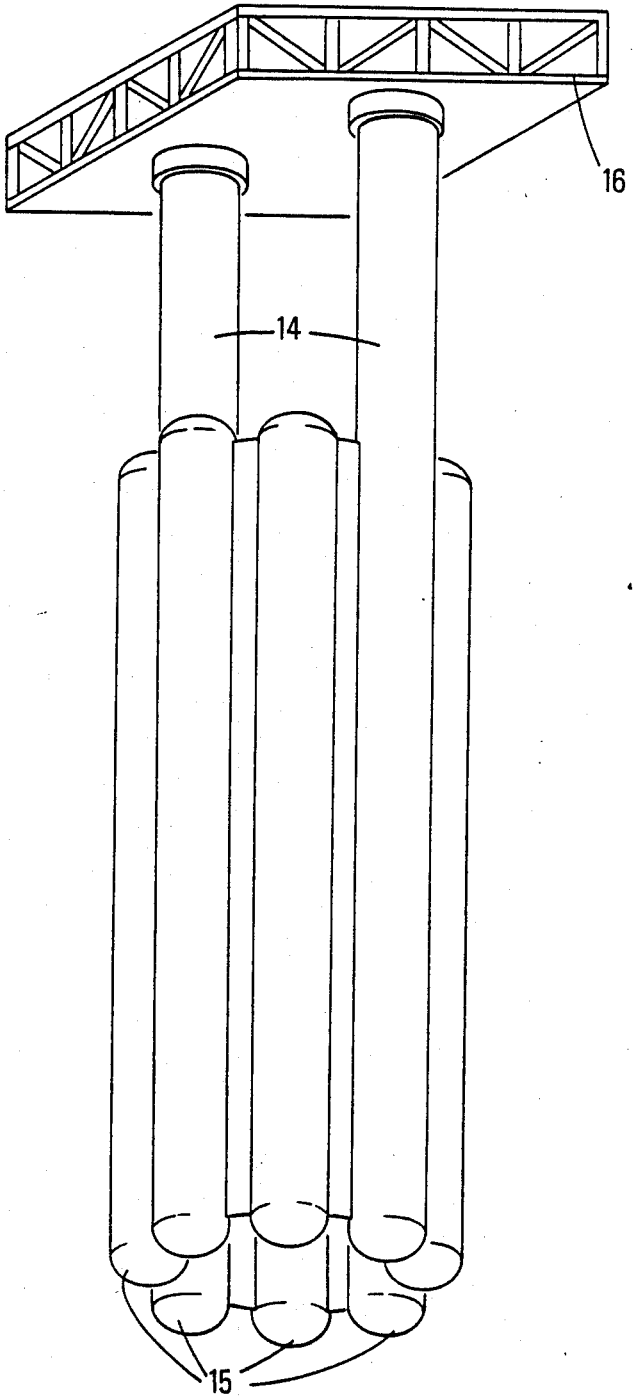
FIG. 8 illustrates a particular embodiment of the installation.

According to one particular embodiment, the floatation cylinder or cylinders 14 may be inserted among the storage and ballast cylinders 15 disposed possibly along the arc of a circle. Of course, the structure thus obtained may form a complete ring (FIG. 8). In this FIG. 8, a deck 16 has been shown connected directly to the floatation cylinders 14. But, still within the scope of the present invention, the deck may be connected to at least one floatation cylinder an/or to storage or ballast cylinders by assembly legs.

Moreover, in this case, a part of the floatation cylinder or cylinders may serve for storage or ballasting. Cross pieces or stiffeners may be disposed in the center of the ring so as to increase the rigidity thereof.

Figure 7:
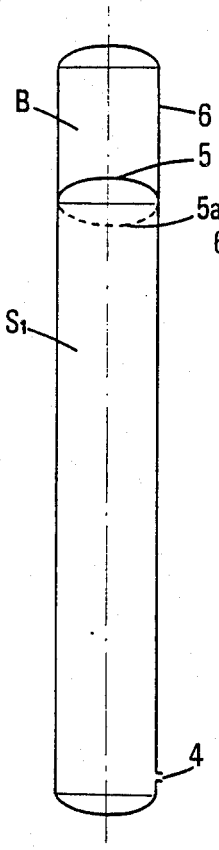
FIG. 7 illustrates an advantageous embodiment of a peripheral cylinder in which a ballast chamber is situated over a storage chamber.
Figure 7A:
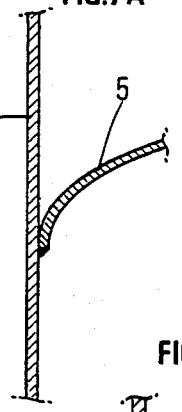
FIGS. 7A and 7B illustrate a detailed view of the embodiment of FIG. 7.
Figure 7B:
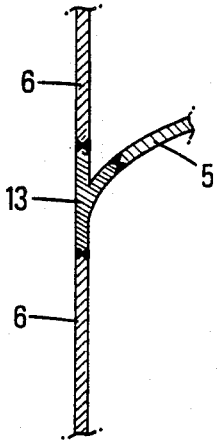

In one advantageous embodiment, illustrated in FIGS. 7, 7A and 7B, some at least of the peripheral cylinders $A_2,A_3$. . . comprise an internal dividing wall 5 or **5*a* connected by welding to the shell 6 of the cylinder, either directly, or by means of a piece 13. This internal dividing wall 5 or 5*a*** defines at the upper part of the cylinder a ballasting chamber B over a storage chamber $S_1$.

In a particular embodiment, the ring of storage cylinders $A_2,A_3$. . . is rigidly fixed by welding to the floatation cylinder $A_1$ over a height h less than the height H of the cylinder $A_1$ (since the cylinders $A_2,A_3$. . . descend below the cylinder $A_1$), but representing at least 25% of the height H.

Figure 6:
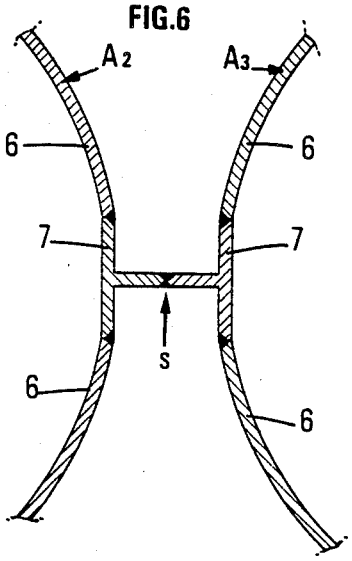
FIG. 6 illustrates a method of assembling the cylinders by welding.

In order to facilitate the construction of such a modular system, it will be advantageous to incorporate in the shell 6 of each cylinder ($A_1,A_2,A_3$. . .) a connecting element 7 during manufacture of this shell, the assembly of two adjacent cylinders then being provided by welding S between the connecting elements 7 with which these cylinders are equipped (FIG. 6).

Another variant for securing the cylinders together consists in replacing the two sections of elements 7 by a single section having a shape of a I.

The system of the invention will be anchored on the site chosen by any appropriate means, such as funicular anchorage by chains or cables connected to anchors or anchorage buoys, anchorage by guys, or axial anchorage.

Figure 1A:
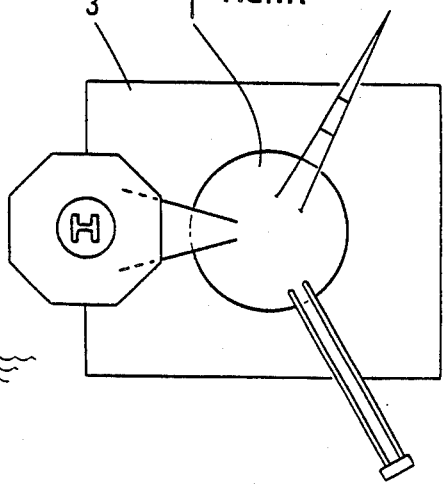
FIG. 1A is a top view of the installation.
Figure 1B:
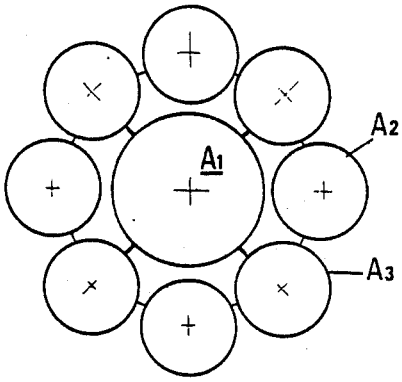
FIGS. 1B and 1C correspond to sections through the horizontal planes B—B and C—C respectively, shown in FIG. 1, FIGS. 2, 3, 4, 5 show different transport and on site installation methods.
Figure 2:
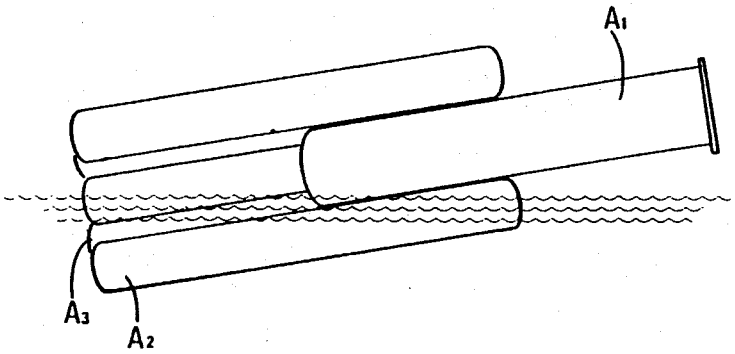
Figure 3:
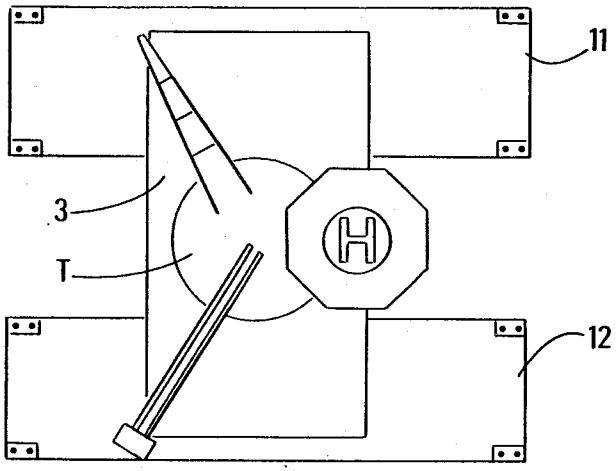

A flare for burning the gases may be supported by a cantilever arm on one side of platform 3 or may float on the water at a certain distance from the system while being connected thereto by a flexible duct. Since a shuttle tanker must be able to tie up and travel freely around the production system, the flare, the helicopter deck and the mooring point for the tanker will be fixed to a rotary table (T) (FIGS. 1A and 3), the distance between these three pieces of equipment remaining constant. The positioning of this system on the chosen site may be advantageously provided by towing the cylinder assembly (FIG. 2) separately from the deck which has been set afloat, for example by means of barges 11 and 12 (FIG. 3). By ballasting certain cylinders, the cylinder assembly is rocked into a vertical position and the connection between the deck which remains horizontal and the cylinder assembly in the vertical position is then carried out on the site. For this, the deck and the cylinder assembly, will be connected together by members allowing them to be readily connected together and disconnected on the site.

Figures 4, 5:
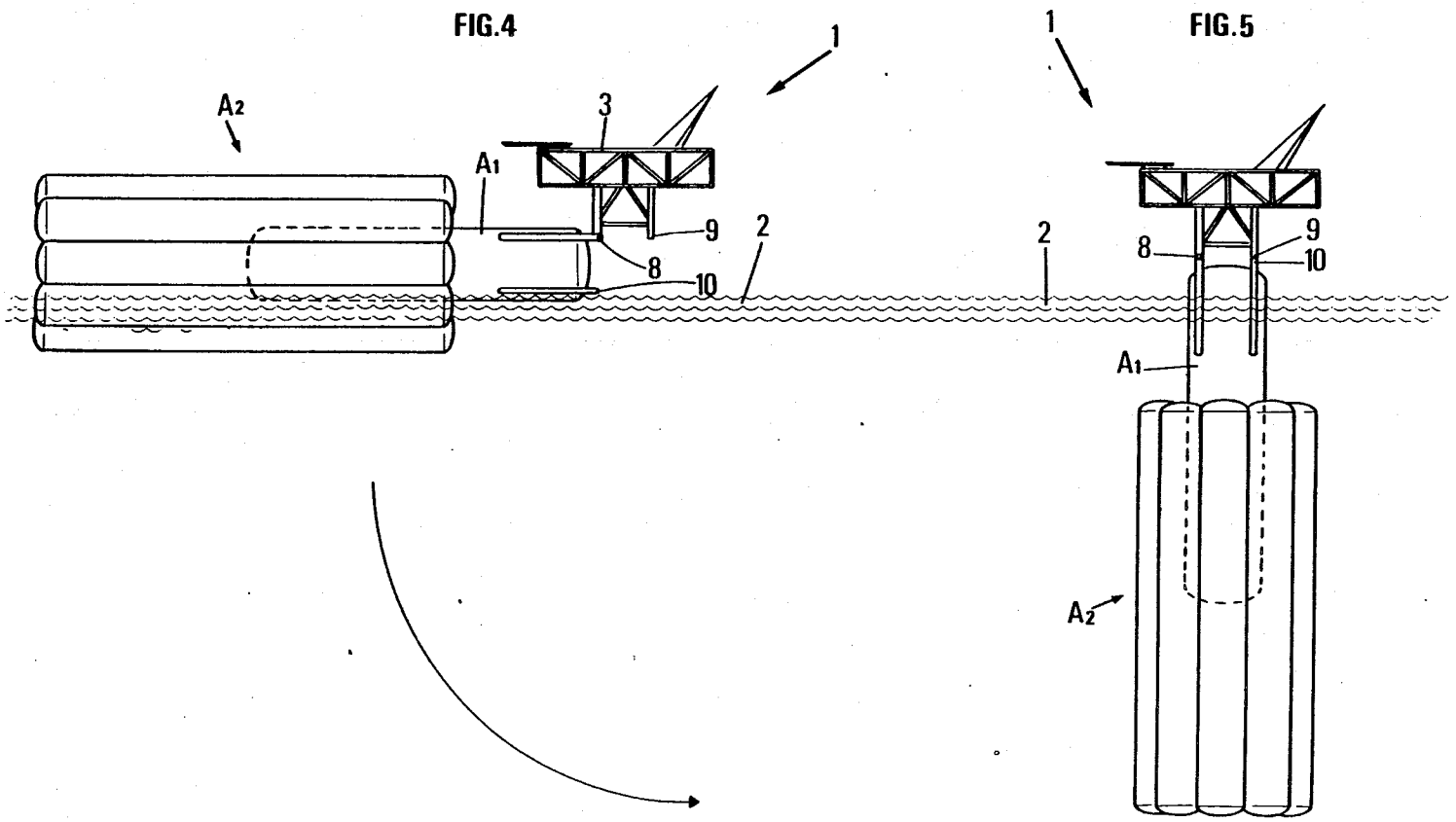

Another advantageous embodiment is shown in FIG. 4. The deck or platform 3 is connected to the floatation cylinder by at least one hinge connection 8 allowing the production assembly, inclusive of deck 3, to be transported in the horizontal position, after disengagement of the connecting members 9 and 10, this transport to the chosen site being carried out by towing at the surface of the water.

During the whole of this transport phase, the horizontal position of platform 3 is maintained by ballasting this platform and/or by using guys, braces or hydraulic cylinders connecting this platform to cylinders $A_1$, $A_2$, $A_3$. . .

When the system has reached the chosen site, the assembly of cylinders $A_1,A_2,A_3$. . . is brought to a vertical position, whereas deck 3 remains in a horizontal position. The connecting members 9 and 10 are then joined together (FIG. 5).

Figure 1:
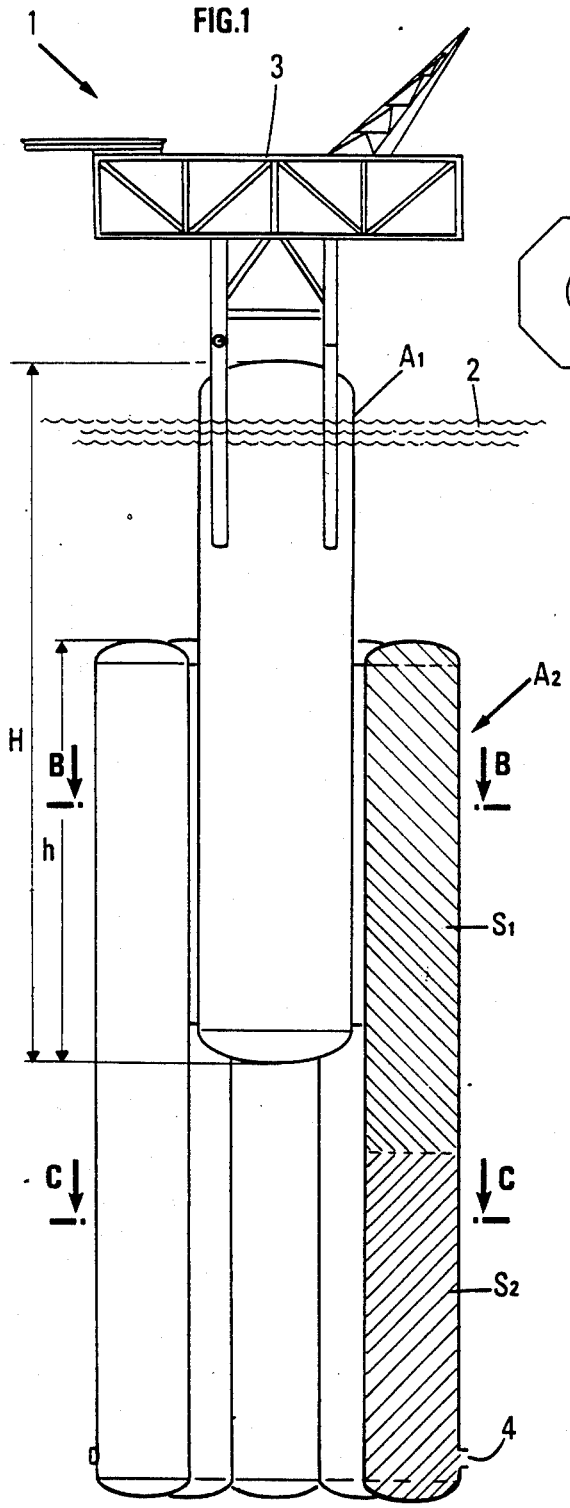
FIG. 1 is a general schematic view of a modular system in accordance with the invention in a vertical position in the water
Figure 1C:
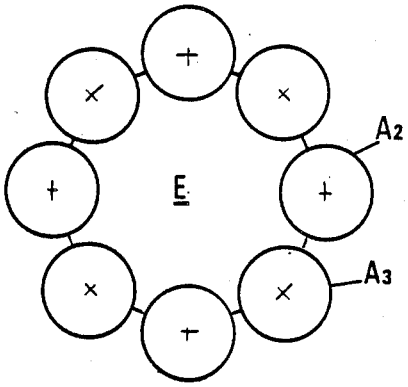

The system of the invention comprises regulation means 17 adapted for compensating the buoyancy variation of this system following variations of the water-oil level 18 in the storage cylinders (FIG. 1).

The difference in density between the water and the oil results in fact in an apparent variation of weight in the water of the system, during filling or emptying of the storage reservoirs.

So as to prevent corresponding variations of the draft of the structure which may hinder loading of the oil ships and affect the static stability of the system, as shown in FIG. 9 this latter may be equipped with detectors 19 of variations in the level 19 of the oil-water interface in the storage reservoirs, these detectors 19 controlling the intake 20 or the discharge 21 of oil or water 22 or inert gas or air 23 into or from the ballast chambers B.

What is claimed is:

1. A floating modular system comprising an assembly of cylinders disposed about a common axis and connected rigidly together, the cylinders comprising:

metal storage cylinders for storing oil on a water column communicating with water surrounding the system, a level of the water in said metal storage cylinders falling or rising in dependence upon whether oil is stored or withdrawn from the cylinders, said storage cylinders being disposed entirely below the level of the surrounding water, and a plurality of metal ballast cylindrical members filled with at least one of oil, water, air and inert gas, and associated with regulating means for compensating for a variation in buoyancy of the modular system following variations of the water-oil level in said storage cylinders, said metal ballast cylindrical members being disposed below the level of the surrounding water, at least one middle floatation cylinder is surrounding at least partially by said storage cylinders and said ballast cylindrical members which form an assembly of peripheral cylinders, said flotation cylinder being adapted to occupy a vertical position in use, a bottom of said flotation cylinder being situated below a level of the water and the top of said flotation cylinder emerging above the level of the water and supporting at least one of a deck and platform comprising at least one of production and living equipment, said peripheral cylinders being adapted to descend below the bottom of said flotation cylinder.

2. The system as claimed in claim 1, comprising an assembly of storage cylinders adapted to descend below the bottom of the at least one floatation cylinder and fixed rigidly thereto over at least 25% of a height of the at least one floatation cylinder.

3. A floating modular system comprising an assembly of cylinders disposed about a common axis and connected rigidly together, the cylinders comprising:

metal storage cylinders for storing oil on a water column communicating with water surrounding the system, a level of the water in said metal storage cylinders falling or rising in dependence upon whether oil is stored or withdrawn from the cylinders, said storage cylinders being disposed entirely below the level of the surrounding water, and at least one metal ballast cylindrical member filled with at least one of oil, water, air and inert gas, and associated with regulating means for compensating for a variation in buoyancy of the modular system following variations of the water-oil level in said storage cylinders, said metal ballast cylindrical member being disposed below the level of the surrounding water, and wherein the assembly of cylinders are separable and interlockable on a site from at least one of a deck and a platform so as to allow for at least one of transporting and towing separately of the at least one of the deck and platform from the cylinders then the interlocking of at least one of the deck and platform and the assembly of cylinders, and at least one of the deck and platform remaining in the horizontal position with the assembly of cylinders brought to the vertical position.

4. The system as claimed in claim 1, wherein the at least one of the deck and platform is connected to said floatation cylinder by a hinge joint connection means for allowing a production assembly thereof, including the at least one of the deck or platform, to be transported in the horizontal position, the assembly of the cylinders brought to a vertical position on the site, whereas the deck remains in the horizontal position.

5. The system as claimed in claim 1, wherein some at least of said peripheral cylinders comprise an internal dividing wall defining at the upper part thereof a ballast chamber disposed over a storage chamber.

* * * * *